US006450895B1

(12) United States Patent
Galluzzo, Jr.

(10) Patent No.: US 6,450,895 B1
(45) Date of Patent: Sep. 17, 2002

(54) GOLF PRACTICE DEVICE WITH ADJUSTABLE GOLF BALL TEE PLATFORM AND ADJUSTABLE LEG STANCE PLATFORM

(76) Inventor: Denny J. Galluzzo, Jr., 8127 W. Eastman Pl., No. 11-102, Lakewood, CO (US) 80227

( * ) Notice: Subject to any disclaimer, the term of this patent is extended or adjusted under 35 U.S.C. 154(b) by 0 days.

(21) Appl. No.: 09/587,508

(22) Filed: Jun. 5, 2000

(51) Int. Cl.[7] ..... A63B 69/36
(52) U.S. Cl. ..... 473/279
(58) Field of Search ..... 473/278, 279

(56) References Cited

U.S. PATENT DOCUMENTS 1,810,906 A * 6/1931 Carter ..... 473/279 X
2,879,996 A * 3/1959 Lederer ..... 473/279
3,639,923 A * 2/1972 Stewart ..... 473/279 X
4,779,796 A * 10/1988 Lai ..... 473/279
4,875,685 A * 10/1989 Ballinger et al. ..... 473/279 X
5,046,741 A * 9/1991 Ahn ..... 473/279
5,944,615 A * 8/1999 Lee ..... 473/279
6,135,895 A * 10/2000 Estivo et al. ..... 473/278

FOREIGN PATENT DOCUMENTS

GB 2238250 * 5/1991 ..... 273/195 B

* cited by examiner

*Primary Examiner*—Raleigh W. Chiu
(74) *Attorney, Agent, or Firm*—Edwin H. Crabtree; Ramon L. Pizarro; Donald W. Margolis

(57) ABSTRACT

A golf practice device for a golfer hitting golf balls. The practice device having two different platforms which are adjustable for different golfer leg stances and different golf ball lies. The golfer, using the device, can practice various leg stances when standing uphill, downhill and sidehill. Also, the golfer using device can practice hitting golf balls having a variety of different lies uphill, downhill and side hill. Broadly, the device includes a golfer leg stance platform connected to a separate golf ball tee platform. The leg stance platform includes adjustable legs mounted on the bottom of four corners of the platform. The legs are used for raising and lowering the stance platform at various angles from the horizontal. The stance platform is connected to the golf tee platform using a flexible tubing. The flexible tubing allows the tee platform to be moved in a three dimensional space.

11 Claims, 2 Drawing Sheets

GOLF PRACTICE DEVICE WITH ADJUSTABLE GOLF BALL TEE PLATFORM AND ADJUSTABLE LEG STANCE PLATFORM

BACKGROUND OF THE INVENTION

Field of the Invention

This invention relates to a device used in the practice of hitting golf balls and more particularly, but not by way of limitation, to a golf practice device having a golf ball tee platform and a leg stance platform which are adjustable in three dimensions for practicing the hitting of golf balls having various lies.

In U.S. Pat. No. 5,720,670 to Oxley et al., U.S. Pat. No. 5,527,042 to Spriddle, U.S. Pat. No. 4,875,685 to Ballinger et al., U.S. Pat. No. 3,639,923 to Stewart and U.S. Pat. No. 2,879,996 to Lederer various types of golf practice platforms are disclosed which can be raised and lower and positioned to simulate uphill, downhill and sidehill golf ball lies.

None of these golf practice devices specifically disclose the combination of structure, function and features of the subject invention, which allow a golfer to practice hitting golf balls positioned in a three dimensional space with different lies and with different leg stances. The golf lies having various degrees of difficulty, which a golfer might encounter during a game of golf.

SUMMARY OF THE INVENTION

In view of the foregoing, it is a primary object of the subject invention to provide a golf practice device for a golfer to practice hitting golf balls. The practice device having two different platforms. The platforms being adjustable for different golfer leg stances and different golf ball lies.

Another object of the invention is the golf practice device can be adjusted in three dimensions for hitting the golf ball at various positions. Also, the golfer, using the device, can practice various leg stances when standing uphill, downhill and sidehill. Also, the golfer can use the device for practicing hitting golf balls having a variety of different lies uphill, downhill and sidehill.

Yet another object of the invention is practice device can be used to simulate a variety of golf leg stances and golf ball lies encountered by a golfer when playing golf courses with different topographies. The invention can be used by golfers for practice at home. Also, the golf practice device can be used at commercial establishments such as golf driving ranges, golf courses and other areas used for practicing golf shots.

The golf practice includes a golfer leg stance platform connected to a separate golf ball tee platform. The leg stance platform includes adjustable legs mounted on the bottom of four corners of the platform. The legs are used for raising and lowering the stance platform at various angles from the horizontal. The stance platform is connect to the golf ball tee platform using a flexible tubing. The flexible tubing allows the tee platform to be moved in a three dimensional plane.

The tee platform is used for placing a golf ball thereon. By moving the tee platform at various angles from the horizontal and the vertical, the golf ball can be positioned from easy to difficult lies.

These and other objects of the present invention will become apparent to those familiar with the different types of golf practice devices and platforms used for hitting golf balls when reviewing the following detailed description, showing novel construction, combination, and elements as herein described, and more particularly defined by the claims, it being understood that changes in the embodiments to the herein disclosed invention are meant to be included as coming within the scope of the claims, except insofar as they may be precluded by the prior art.

BRIEF DESCRIPTION OF THE DRAWINGS

The accompanying drawings illustrate complete preferred embodiments of the present invention according to the best modes presently devised for the practical application of the principles thereof, and in which.

DESCRIPTION OF THE PREFERRED EMBODIMENTS

Figure 1:
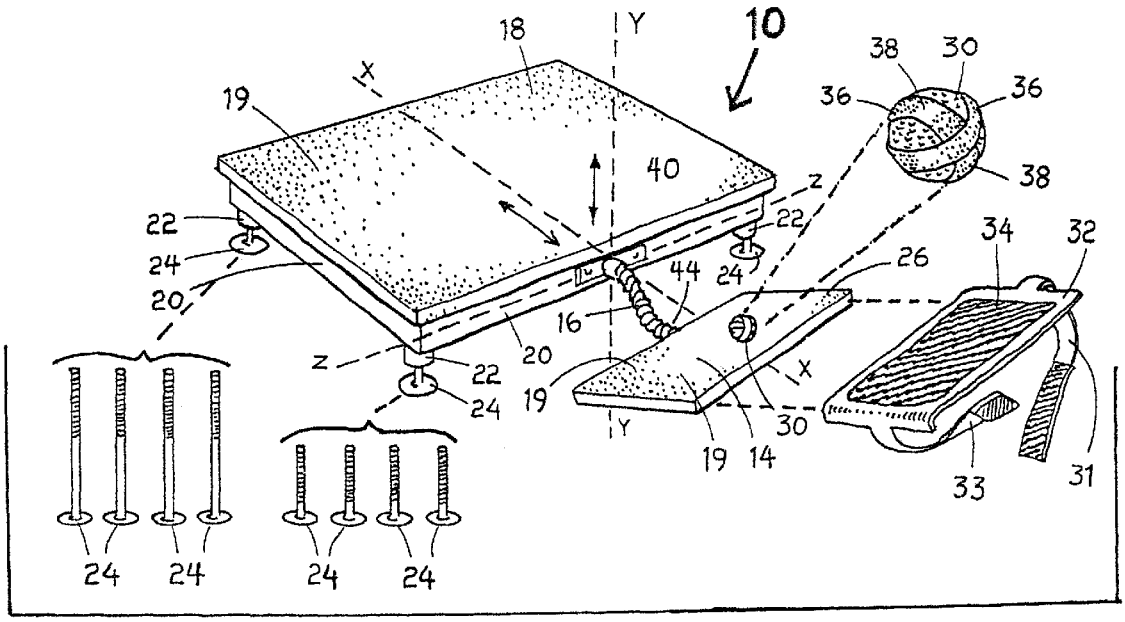
FIG. 1 is a perspective view of the subject golf practice device. The golf practice device broadly includes an adjustable leg stance platform connected to a separate golf tee ball platform. The golf ball tee platform is adjustable in a three dimensional space.

FIG. 1, a perspective view of the subject golf practice device is illustrated having a general reference numeral 10. The golf practice device 10 broadly includes an adjustable leg stance platform 12 connected to a separate adjustable golf ball tee platform The leg stance platform 12 is connected to the golf ball tee platform 14 using a selected length of flexible tubing 16. The golf ball tee platform 14, using the flexible tubing 16, is adjustable in a three dimensional space make up of a vertical "XY" plane, a vertical "YZ" plane and a horizontal "XZ" plane.

The leg stance platform 12 includes a flat angular shaped top surface 18 for standing thereon. The top surface is covered with an artificial ground turf material 19 for simulating grass on a golf course fairway. The top surface 18 is mounted on a platform frame 20. The platform frame 20 includes threaded collars 22 mounted on its four corners. The threaded collars 22 are used for receiving adjustable threaded legs 24. The threaded legs 24, as shown in FIG. 1, may come in different sizes and lengths and threaded into the collars 24 for raising and lowering the leg stance platform 12 and tilting the platform in an up hill, a down hill or a side hill position.

The golf ball tee platform 14 includes an angular shaped tee surface 26 covered with the artificial ground turf material 19 used for helping hold a golf ball 30 thereon. The golf ball tee platform 14 can also be used for receiving a tee platform sleeve 32 having loop fastener material 34 thereon. The sleeve 32 includes a pair of straps 31 and 33. The straps 31 and 33 have hook and loop fasteners mounted on one end for holding the sleeve 32 on top of the tee platform 14.

The golf ball 30 may include a wrap 36 of hook fastener material 38 therearound. The hook fastener material 38 is used for releasably engaging the loop fastener material 34 on the sleeve 32 and holding the golf ball 30 on the tee platform 14. When the tee platform 14 is moved at various steep angles, which might allow a regular golf ball without the wrap 36 of hook fastener material 38 to roll off of, the use of the hook and loop fastener material 34 and 38 holds the golf ball 30 on the tee platform 14. This feature allows a golfer to practice difficult golf ball lies.

Figure 2:
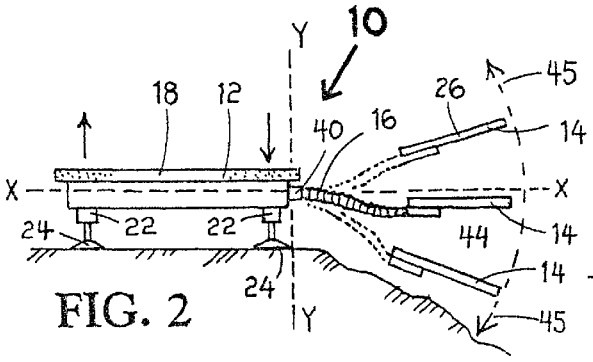
FIG. 2 is a side view of the golf practice device. This drawing illustrates the golf ball tee platform raised and lowered in a vertical "XY" plane.

In this drawing, the flexible tubing 16 is shown having a first end 40 attached to a front side 42 of the platform frame 20. A second end 44 of the flexible tubing 16 is attached under a portion of the tee surface 26 of the golf ball tee platform 14 as shown in FIG. 2. By using the flexible tubing 16, the tee platform 14 with golf ball 30 thereon can be raised and lower in a vertical plane "XY" for simulating side hill lies. Also, the tee platform may be rotated in a vertical plane "YZ" for simulating down hill or up hill lies. Further, the tee platform 14 can be moved to the left or right in a horizontal plane "XZ" for simulating hitting the golf ball 30 off of either the left or right foot.

In FIG. 2, a side view of the golf practice device 10 is depicted. In this drawing,, the golf ball tee platform 14 is illustrated raised and lowered, as shown by arrow 45, in a vertical "XY" plane for simulating side hill lies. The adjustable leg stance platform 12 is shown held in a horizontal position by the threaded legs 24. Obviously, by raising and lowering the two legs 24 next to the front side 42 of the frame 20, the leg stance platform 12 can be adjusted for simulating a golfer standing on the side of a hill.

While the adjustable legs 24 are shown in the drawings, it should be kept in mind, permanent legs with various heights can be used equally well on any number of leg stance platforms 12. For example, two of the front permanent legs can be longer then the rear two legs for practicing up hill leg stances when a golfer uses this particular leg stance platform 12. In turn, one of the leg stance platforms 12 can have shorter front legs and longer rear legs for practicing down hill leg stances when using this platform.

Figure 3:
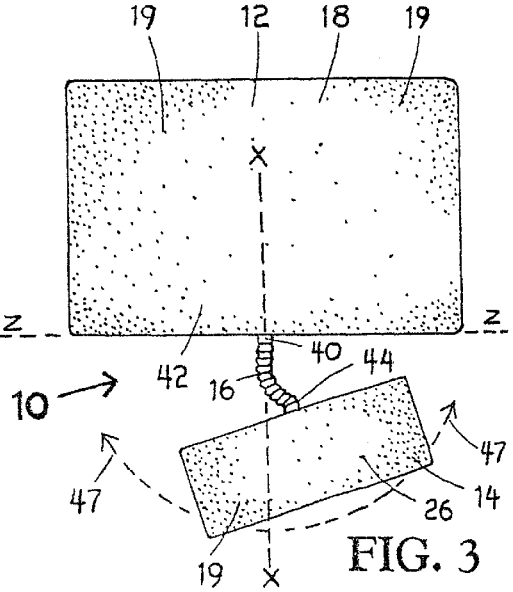
FIG. 3 is a top view of the golf practice device. The drawing illustrates the golf ball tee platform moved to the left and right in a horizontal "XZ" plane.

In FIG. 3, a top view of the golf practice device 10 is shown. This drawing illustrates the golf ball tee platform 14 moved to the left or right, as shown by arrow 47, in a horizontal "XZ" plane using the flexible tubing 16.

Figure 4:
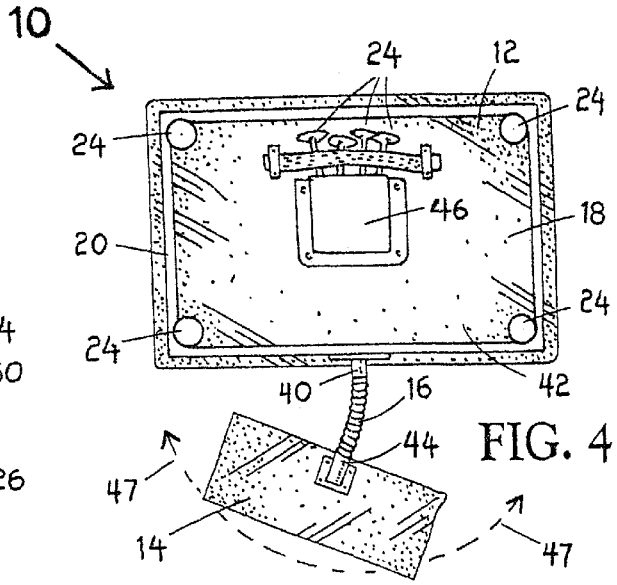
FIG. 4 is a bottom view of the golf practice device illustrating the bottom of the leg stance platform with a storage area for holding different lengths of threaded platform legs. Also, the bottom of the golf tee platform is shown.

In FIG. 4, a bottom view of the golf practice device 1 is shown. The drawing illustrates the bottom of the leg stance platform 12 with a leg storage compartment 46 used for holding extra threaded platform legs 24. Also, the bottom of the golf tee platform 14 is shown with the second end 44 of the flexible tubing 16 connected thereto.

Figure 5:
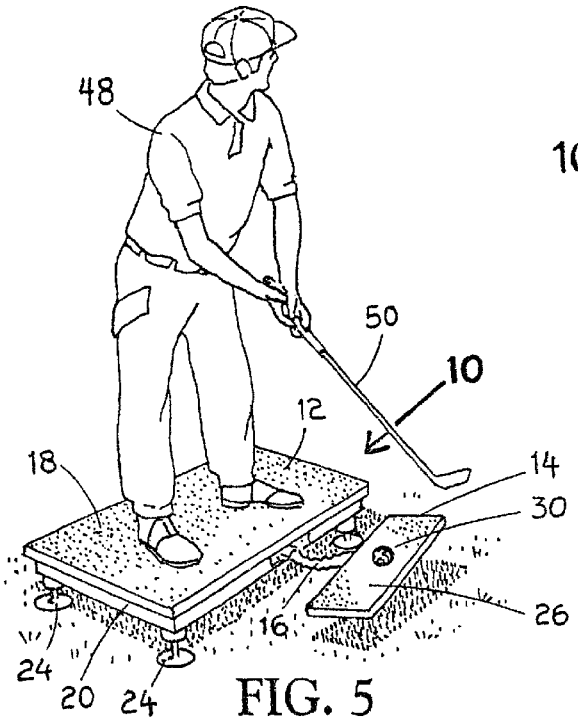
FIG. 5 is a perspective view of a golfer standing on the leg stance platform. The golfer is shown addressing a golf ball on the golf ball tee platform. The tee platform is angled upwardly to simulate an up hill lie.

In FIG. 5, a perspective view of a golfer 48 is shown standing on the leg stance platform 12 with a golf club 50 addressing the golf ball 30 on the golf ball tee platform 14. The tee platform 14 is shown angled upwardly to simulate an up hill lie. The leg stance platform 12 is shown in a level horizontal position While the invention has been shown, described and illustrated in detail with reference to the preferred embodiments and modifications thereof, it should be understood by those skilled in the art that equivalent changes in form and detail may be made therein without departing from the true spirit and scope of the invention as claimed, except as precluded by the prior art.

The embodiments of the invention for which an exclusive privilege and property right is claimed are defined as follows:

1. A golf practice device for a golfer hitting a golf ball, the golf practice device comprising:

a leg stance platform adapted for the golfer to stand thereon;

a golf ball tee platform adapted for receiving a golf ball thereon;

tee platform connection means for adjusting said tee platform in a three dimensional space, said connection means connected to said stance platform and said tee platform; and a sleeve having loop fastener material thereon, said sleeve removably attached to said golf ball tee platform.

2. The golf practice device as described in claim 1 herein said tee platform connection means is a length of flexible tubing, a first end of said tubing attached to a portion of said leg stance platform, a second end of said tubing attached to a portion of said golf ball tee platform.

3. The golf practice device as described in claim 1 further including adjustable legs mounted on four corners of said leg stance platform, said legs used for raising and lowering said leg stance platform.

4. A golf practice device for a golfer hitting a golf ball, the golf practice device comprising:

a leg stance platform adapted for the golfer to stand thereon;

means for raising and lowering said leg stance platform, said means for raising and lowering attached to said leg stance platform;

a golf ball tee platform adapted for receiving a golf ball thereon; and a length of flexible tubing, a first end of said tubing attached to a portion of said leg stance platform, a second end of said tubing attached to a portion of said golf tee platform, whereby said tubing allows the tee platform to be moved in a three dimensional space.

5. The golf practice device as described in claim 4 wherein said means for raising and lowering are adjustable legs mounted on four corners of said leg stance platform, said legs used for raising and lowering said leg stance platform.

6. The golf practice device as described in claim 4 further including artificial turf material mounted on top of said leg stance platform.

7. The golf practice device as described in claim 4 further including artificial turf material mounted on top of said golf ball tee platform.

8. A golf practice device for a golfer hitting a golf ball, the golf practice device adjustable in a "XY" vertical plane, adjustable in a "XZ" vertical plane and in a "XZ" horizontal plane, the golf practice device comprising:

a leg stance platform with a first gripping surface thereon, said leg stance platform adapted for the golfer to stand thereon;

adjustable legs attached to a bottom of said leg stance platform, said legs for raising and lowering said leg stance platform in the "XY" vertical plane;

a golf ball tee platform with a second gripping surface thereon, adapted for receiving a golf ball thereon; and a length of flexible tubing, a first end of said tubing attached to a portion of said leg stance platform, a second end of said tubing attached to a portion of said golf ball tee platform; whereby said tubing allows said tee platform to be moved raised and lowered in the "XY" vertical plane, said tubing allows said tee platform to be moved left and right in the "XZ" horizontal plane, said tubing allows said tee platform to be rotated in a "YZ" vertical plane.

9. The golf practice device as described in claim 8 wherein said first gripping surface is artificial turf material mounted on top of said leg stance platform.

10. The golf practice device as described in claim 8 wherein said second gripping surface is artificial turf material mounted on top of said golf ball tee platform.

11. The golf practice device as described in claim 8 further including a sleeve having loop fastener material thereon, said sleeve removably attached to said golf ball tee platform, said loop fastener material adapted for releasable engagement of hook fastener material received on the golf ball.

* * * * *